United States Patent [19]

Busch-Vishniac et al.

[11] Patent Number: 4,558,184

[45] Date of Patent: Dec. 10, 1985

[54] INTEGRATED CAPACITIVE TRANSDUCER

[75] Inventors: Ilene J. Busch-Vishniac, Austin, Tex.; W. Stewart Lindenberger, Somerset, N.J.

[73] Assignee: AT&T Bell Laboratories, Murray Hill, N.J.

[21] Appl. No.: 572,683

[22] Filed: Jan. 20, 1984

Related U.S. Application Data

[63] Continuation-in-part of Ser. No. 469,410, Feb. 24, 1983, abandoned.

[51] Int. Cl.[4] ..... H04R 23/02

[52] U.S. Cl. ..... 179/111 R; 29/594

[58] Field of Search ..... 179/111 R, 111 E, 110 A; 29/25.41, 594

[56] References Cited

U.S. PATENT DOCUMENTS

| | | | |
|---|---|---|---|
| 4,070,741 | 2/1978 | Djuric | 29/594 |
| 4,261,086 | 4/1981 | Giachino | 29/25.41 |
| 4,321,432 | 3/1982 | Matsutani | 179/111 R |
| 4,415,948 | 11/1983 | Grantham | 29/25.41 |
| 4,495,385 | 1/1985 | Roberts | 179/111 R |

FOREIGN PATENT DOCUMENTS

| | | | |
|---|---|---|---|
| 58-215898 | 12/1982 | Japan | 179/111 R |
| 58-120400 | 7/1983 | Japan | 179/111 R |

*Primary Examiner*—Thomas W. Brown
*Assistant Examiner*—L. C. Schroeder
*Attorney, Agent, or Firm*—Lester H. Birnbaum

[57] ABSTRACT

Disclosed is an electroacoustic transducer, such as a microphone, which may be integrated into a semiconductor chip and a method of fabrication. The semiconductor is etched to produce a membrane having a sufficiently small thickness and an area so as to vibrate at audio frequencies. Electrodes are provided in relation to the membrane so that an electrical output signal can be derived from the audio frequencies, or vice versa, due to variable capacitance. Preferably, the sensitivity of the device is made to be an approximately linear function of sound pressure level to be compatible with amplification.

18 Claims, 10 Drawing Figures

INTEGRATED CAPACITIVE TRANSDUCER

CROSS-REFERENCE TO RELATED APPLICATIONS

This application is a continuation-in-part of U.S. patent application Ser. No. 469,410, filed Feb. 24, 1983 now abandoned.

BACKGROUND OF THE INVENTION

This invention relates to electroacoustic transducers, such as microphones, which may be integrated into a semiconductor substrate including other components.

With the proliferation of integrated circuits and ever smaller electronic devices, a desire has grown to form a miniature transducer which could be included with said circuitry. These transducers may include, for example, microphones incorporated into the circuitry of telecommunications and audio recording equipment, hearing aid microphones and speakers, general miniature speakers, or control element for filtering and switching. At present, miniature microphones are usually of the electret type. Such microphones typically comprise a foil (which may be charged) supported over a metal plate on a printed circuit board so as to form a variable capacitor responsive to variations in voice band frequencies. While such devices are adequate, they require mechanical assembly and constitute components which are distinctly separate from the integrated circuitry with which they are used. A microphone which was integrated into the semiconductor chip and formed by IC processing would ultimately have lower parasitics and better performance, be more economical to manufacture, and require less space.

Consequently, it is a primary object of the invention to provide an electroacoustic transducer which is integrated into a semiconductor substrate.

SUMMARY OF THE INVENTION

This and other objects are achieved in accordance with the invention which in its device aspects is an electroacoustic transducer including a membrane comprising a thinned portion of a thicker semiconductor substrate. The membrane has a thickness of less than 2.5 μm and an area such that it is adapted to vibrate at a frequency of at least 0.02 kHz. The transducer includes a pair of electrodes formed in a spaced relationship so as to constitute a capacitor. One of the electrodes is formed to vibrate with the membrane such that the electric field between the electrodes varies in relationship with the vibrating membrane to permit conversion between electrical and acoustic signals.

BRIEF DESCRIPTION OF THE DRAWING

These and other features of the invention are delineated in detail in the following description. In the drawing.

It will be appreciated that for purposes of illustration, these figures are not necessarily drawn to scale.

DETAILED DESCRIPTION OF THE INVENTION

Figure 1:
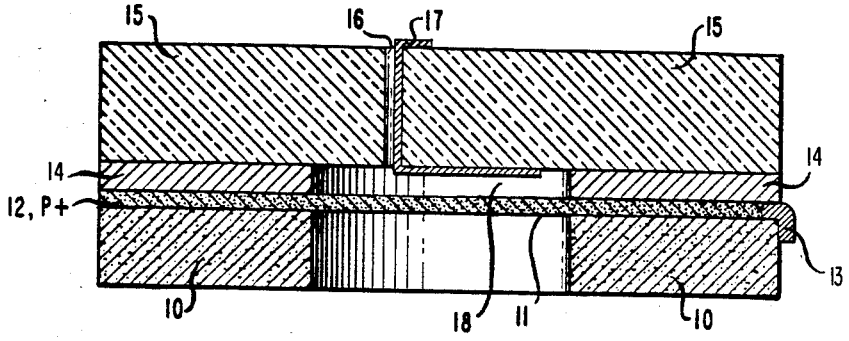
FIG. 1 is a cross-sectional view of a device in accordance with one embodiment of the invention.

An illustrative embodiment of a microphone is shown in the cross-sectional view of FIG. 1. It will be appreciated that although only the microphone is shown, other components may be incorporated at other portions of the semiconductor substrate to form an integrated circuit.

The substrate, 10, in this example is a p-type silicon wafer having a uniform initial thickness of 15–20 mils. (Either p- or n-type substrates may be employed as required by the other elements in the substrate.) A silicon membrane, 11, is formed from a thinned down portion of the substrate. In this example, the thickness of the membrane is approximately 0.7 μm and in general should be within the range 0.1–2.5 μm for reasons discussed later. A boron-doped ($p^+$) region, 12, is included in the surface of the substrate in this example to facilitate formation of the membrane. That is, the region, 12, acts as an etch-stop when a chemical etch is applied to the back surface of the substrate to define the thickness of the membrane. Further, since the $p^+$ region has a fairly high conductivity (approximately $10^3$ (ohm-cm)$^{-1}$), the region can constitute one electrode of a capacitor. Thus, the $p^+$ region, 12, needs to extend only so far laterally in the substrate, 10, as to allow for misalignment during the backside etching and to permit contact to be made. However, further extension of this region is permissable. A contact, 13, which is formed at an edge area removed from the membrane serves both to supply a bias and provide an output path from the membrane. Alternatively, a layer of metal could be deposited on either major surface of the membrane to form the electrode. It should be understood that in the attached claims, where an electrode is recited, it is intended to include the cases where the electrode is the membrane itself or a metal electrode formed thereon.

In this example, the membrane is formed in the shape of a circle with a diameter of approximately 6 mm by means of a photoresist pattern (not shown) formed on the back surface of the substrate. The area of the membrane may be varied in accordance with the criteria discussed below. An etchant which may be utilized in this example is a mixture of ethylenediamine, pyrocatechol and water in a ratio of 17:3:8 at a temperature of 90 degrees C.

Formed on selected portions of the substrate other than the membrane area is a layer of polycrystalline silicon, 14, or other suitable insulating material. The layer is approximately 0.75–2.0 μm thick and deposited by standard techniques such as chemical vapor deposition. The polysilicon layer serves as a spacing layer for the glass cover, 15, which is bonded to the polysilicon by means of electrostatic bonding. The glass cover is approximately 1/16 inch thick and includes a hole, 16, formed therethrough with a diameter of approximately 5-10 mils. A metal layer, 17, is plated, prior to bonding, on the side of the cover facing the semiconductor and through the hole. In this example, the metal is a mixture of Au and Ni which is plated by standard techniques to a thickness of approximately 1000 Å–1.0 μm. Typically, the area of the electrode is approximately 80% of the area of the diaphragm.

As shown, the cover, 15, is bonded to the polysilicon layer, 14, so as to form an air cavity, 18, over the membrane. The portion of the metal layer, 17, on the surface of the cover facing the membrane constitutes the second electrode of the capacitor which is connected to a bias through the hole, 16.

Thus, in operation, acoustic waves which are incident on the surface of the membrane will cause it to vibrate thereby varying the distance between the capacitor electrodes. When a bias is supplied to the electrodes through a load element (such as a second fixed capacitor or resistor), the variations in capacitance caused by the acoustic input are manifested by a change in the voltage across the capacitor, and so an electrical equivalent to the acoustic signal is produced. The hole, 16, performs an important function in addition to allowing contact to layer 17. That is, it permits escape of air in the cavity so that air stiffness is not a factor in the membrane motion. Without this air vent, the resonant frequency will be too high and the output signal at telecommunications frequencies will be too low.

It can be shown that energy transmitted from a vibrating circular membrane, when air cavity stiffness can be ignored due to a pressure vent such as 16, is governed by the expression:

$$D\left(\frac{2\pi}{\lambda}\right)^4 + Ts\left(\frac{2\pi}{\lambda}\right)^2 = \rho_s\omega^2 \tag{1}$$

where D is the bending modulus of the membrane, $\lambda$ is the wavelength of the fundamental mode of the energy, T is film tension of the membrane, s is the thickness of the membrane, $\rho_s$ is the mass per unit area of the membrane, and $\omega$ is the radian frequency of the fundamental mode. Assuming that the membrane behaves as something between a membrane with free edges and one with fully clamped edges, we choose $\lambda=2.6a$, where a is the radius of the membrane, as a reasonable value. Thus, Equation (1) becomes:

$$\omega^2 = \frac{1}{\rho_s}\left[\frac{34.1D}{a^4} + \frac{5.84Ts}{a^2}\right] \tag{2}$$

for an isotropic material such as silicon, the value of D is calculated to be $6.136\times10^{-5}$ dynes-cm based on the Young's modulus and Poisson's ratio of a thin silicon member. It will be noted that for typical values of a (0.05 cm–0.50 cm) and T ($1-10\times10^{10}$ dynes/cm$^2$) in this application, the first term of Equation (2) is small compared to the second term. Further, the resonant frequency is higher than the communications band of 0.5–3.5 kHz.

Thus, the microphone according to the invention can be constructed so that it operates below the resonant frequency in a range which gives an essentially linear output as a function of the input acoustic wave and is essentially independent of the frequency of the external bias. From Equation (1), it can be shown that:

$$V_{ac} = \frac{PV_{DC}\epsilon\chi}{s + \epsilon Y_o} \tag{3}$$

where $V_{ac}$ is the output voltage, P is the amplitude of the acoustic wave, $V_{DC}$ is the external (dc) bias applied to the capacitor, $\epsilon$ is the dielectric constant of the membrane, s is the thickness of the membrane and $Y_o$ is the spacing between capacitor plates. $\chi$ is given by the expression:

$$\chi = \frac{\frac{a^2}{4T}}{\frac{p\gamma a^4}{8V_bT} + 0.8} \tag{4}$$

where p is the cavity pressure, $\gamma$ is the ratio of specific heat at constant pressure to specific heat at constant volume (equal to 1.4 for air) and $V_b$ is the volume of the cavity to which the air is vented (which is typically 0.5 in.$^3$ or more).

Figure 2:
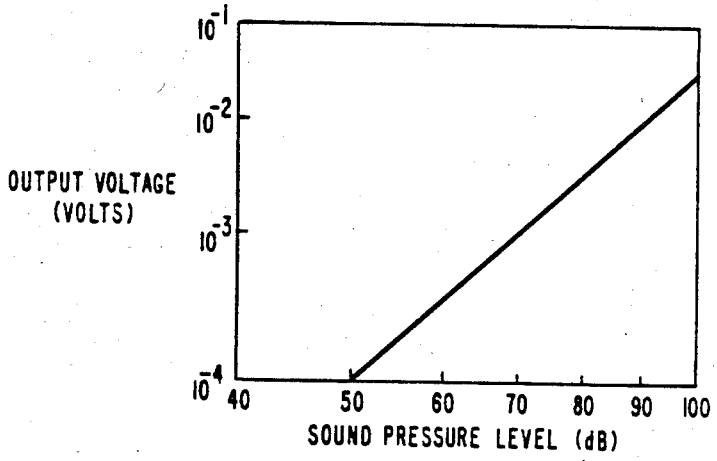
FIG. 2 is a graph of the calculated output voltage of a device in accordance with one embodiment of the invention as a function of sound pressure level on a log-log plot.

FIG. 2 is an illustration of the calculated output voltage of the device of FIG. 1 as a function of sound pressure level (SPL) where a dc bias of approximately 6 volts is supplied and the film tension of the silicon is $10^{10}$ dynes/cm$^2$. The curve represents the response for a device where the membrane thickness is 0.5 $\mu$m, the spacing between the membrane, 11, and electrode, 17, is 1.0 $\mu$m and the radius of the membrane is 2 mm. The normal range for sound pressure level in a telecommunications microphone is shown as 50–100 dB SPL and it will be noted that a useful response is produced. The device produces an essentially linear response which is most desirable for subsequent amplification. Other choices of membrane thickness, dc bias, and film tension can produce useful linear outputs within this sound pressure range. However, the basic requirement is that the voltage output be monotonically increasing in the sound pressure level interval of 50–100 dB (i.e., there is no change in the sign of the slope).

It will be appreciated that choice of thickness of the membrane is an important criteria when a semiconductor such as silicon is utilized. This is primarily due to the fact that silcon has a Young's modulus which is higher (approximately $0.67\times10^{12}$ dynes/cm$^2$) than other materials typically used in microphones where the input frequency will generally vary between 0.5 and 3.5 kHz. It is believed that the maximum thickness for a telecommunications microphone application is 2.5 $\mu$m in order for the membrane to be sufficiently sensitive to the acoustic input. At the same time, the membrane must be thick enough to give mechanical strength. For this reason, a minimum thickness is believed to be 0.1 $\mu$m. Further, as mentioned previously, it is desirable to have an approximately linear output and so the area of the membrane is also an important factor. It is believed that an area within the range 0.01 to 1 cm$^2$ in combination with the thickness range above should give sufficient results. A preferred spacing between the electrodes of the capacitor without an external bias supplied is 0.5–2.5 $\mu$m in order to produce a sufficient output (at least 100 $\mu$V) without the electrodes coming into contract during operation.

Figure 3:
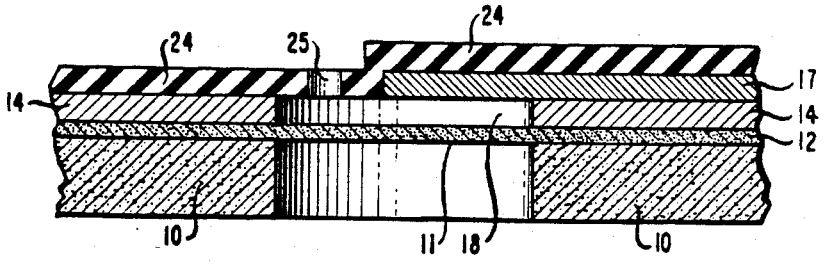
FIG. 3 is a cross-sectional view of a device in accordance with a further embodiment of the invention.

FIG. 3 illustrates an alternative embodiment of the invention which is even more easily integrated into a circuit. Elements corresponding to those of FIG. 1 are similarly numbered. It will be noted that the glass cover has been replaced by at least one insulating layer, 24, which provides mechanical rigidity in addition to that provided by layer 17. In this example, the layer was boron nitride with a thickness of approximately 10 $\mu$m. An air vent, 25, may be formed in the insulating layer.

FIGS. 4–10 illustrate a typical sequence for the fabrication of such a microphone. Each of these steps is compatible with very large scale integrated circuit processing. Although only the microphone is shown, fabrication of other circuit elements in the same substrate is contemplated.

Figure 4:
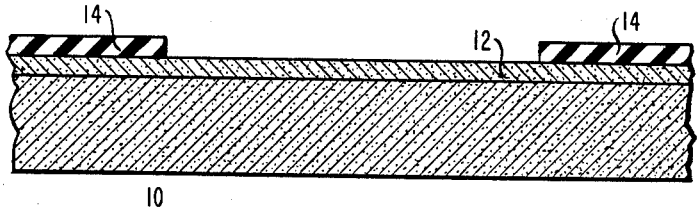
FIGS. 4–10 are cross-sectional views of the device of FIG. 3 during various stages of fabrication in accordance with an embodiment of the method aspects of the invention.

The starting material is typically single crystal <100->silicon, 10 of FIG. 4, in the form of a wafer. There is no requirement as to the presence of any particular dopant or concentration, except that high concentrations of dopant in the bulk of the substrate should be avoided so that the membrane can be formed subsequently by an etch stop technique. Some means for front-to-rear lithographic alignment may be included, such as holes (not shown) drilled through the substrate.

The surface layer, 12, can be formed in the substrate by implantation of boron at a dose of $8\times10^{15}cm^{-2}$ and an energy of 115 KeV to give an impurity concentration of approximately $10^{20}cm^{-3}$ and a depth of approximately 0.5 μm. This implantation could be done at the same time as the formation of source/drain areas of transistors in the substrate. A layer of $SiO_2$ (not shown) could be used to prevent implantation in undesired areas of the substrate. After implantation, the structure is typically heated in a nonoxidizing atmosphere at a temperature of 1,000 degrees C for 15 minutes.

At this point in the processing, it is assumed that all support circuitry has been formed to its top layer of metallization and a protective layer (such as phosphorus-doped glass, hereinafter referred to as P-glass) is formed over the circuitry with openings in areas where subsequent contact to the metallization is required for contact pads or connection to the microphone. If desired, a protective layer of field oxide or P-glass would be included over the microphone area during processing of other areas of the substrate, and such a protective layer (not shown) can be removed by standard etching.

As shown in FIG. 4, a spacing layer, 14, which in this example is silicon nitride, is deposited and patterned by standard techniques to define the area of the membrane. This step can also open holes in layer 14 in areas (not shown) which require contact to metallization in the support circuitry. The layer is approximately 0.65 μm thick. Other insulating layers which are capable of acting as masks to the subsequently applied etchant may also be employed.

Figure 5:
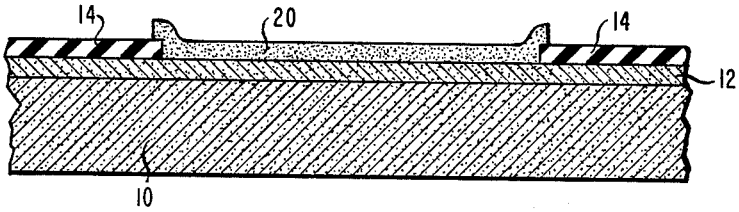
Figure 6:
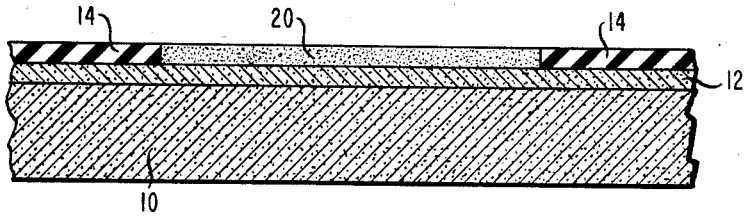

Next, as shown in FIG. 5, a layer of insulating material, 20, is deposited and patterned so as to fill the area of the semiconductor membrane. In this example, the layer is phosphorus-doped glass (P-glass) deposited by chemical vapor deposition to a thickness of approximately 1.2 μm and patterned using standard lithographic techniques and chemical etching with a buffered HF solution. The P-glass will also be removed from the contact pads and interconnection areas of the support circuitry. Then, as shown in FIG. 6, the P-glass is planarized by standard techniques, for example, by covering with a resist and etching by reactive ion etching or plasma techniques.

Figure 7:
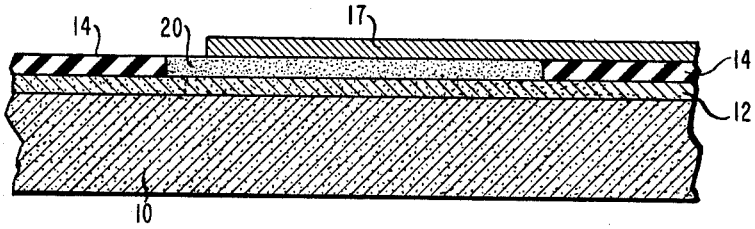
Figure 8:
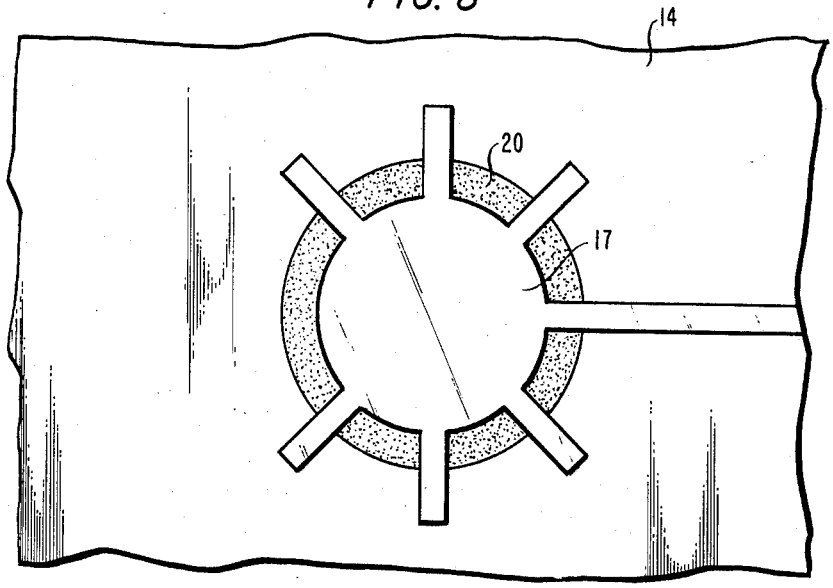

Next, as illustrated in the FIG. 7 cross-sectional view and the FIG. 8 top view, the top electrode, 17, of the capacitor is deposited and defined. In this example, the electrode material is polycrystalline silicon deposited by chemical vapor deposition, doped with phosphorus, and patterned by standard photolithography. The layer should be thick enough to provide mechanical rigidity (approximately 1.5 μm). Other conductors may be used as long as they are not etched in the subsequent processing. It will be noted in FIG. 8 that the electrode may be formed in a spoke pattern over layers 20 and 14 to provide additional mechanical rigidity. The interconnections to support circuitry are also formed during the patterning of the electrode, 17.

Figure 9:
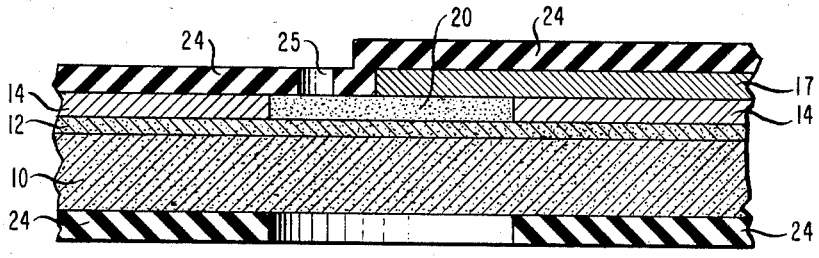

As illustrated in FIG. 9, another insulating layer, 24, is deposited over both major surfaces of the wafer, 10. This layer provides a dual-function of acting as a masking layer on the bottom surface for forming the silicon membrane and as a cover layer for the microphone on the top surface. In this example, the layer is boron nitride deposited by chemical vapor deposition to a thickness of approximately 10 || m. The layer may first be patterned on the top surface by photolithography using plasma etching to provide holes, 25, down to the P-glass filler and to reopen the contact pads (not shown). It will be appreciated that although only one hole is shown in the view of FIG. 9, many holes may be opened, for example, in between each spoke of the electrode. (See FIG. 8.)

The layer, 24, on the bottom surface can then be patterned by photolithography and plasma etching to expose the silicon on the back surface which is aligned with the area on the front surface defining the membrane area as shown in FIG. 9. Of course, the cover on the top surface and the mask on the bottom surface need not be the same material, but the present example saves deposition steps. Other insulating materials which are consistent with the processing may also be used on either the top or bottom surface.

Figure 10:
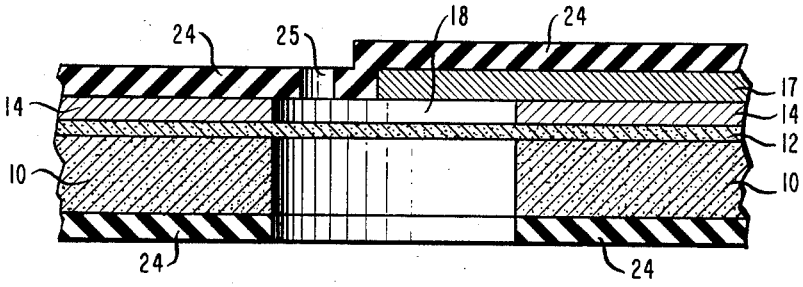

Next as shown in FIG. 10, the air cavity, 18, is formed by removing the P-glass filler 20 with an etchant applied through holes, 25, which does not affect the silicon, 12, or layers, 14, 17, and 24. One such etchant which may be used is buffered hydrofluoric acid. This etching also leaves the electrode, 17, embedded within the cover layer, 24. As shown in FIG. 10, the silicon membrane, 11, can then be formed by etching the wafer from the bottom surface using layer 24 as an etch mask. One technique is to first perform a rapid etch through most of the substrate (for example, using a 90:10 solution of $HNO_3$ and HF), followed by applying an etchant which will stop at the boundary of the high concentration layer, 12. The latter etchant may be a mixture of ethylenediamine, pyrocatechol and water. In most cases, it is probably desirable to leave the layer, 24, on the back surface of the substrate. However, if desired, the bottom layer, 24, may be removed with an etchant while the top layer, 24, is protected by photoresist or other suitable masking so as to give the structure of FIG. 3.

An alternative approach to fabricating the microphone would involve the use of $SiO_2$ for the spacing layer, 14. An electrode, 17, which includes a hole pattern could then be formed over the unpatterned $SiO_2$ layer, followed by deposition of a thick boron nitride layer, 24. Holes could then be formed through the boron nitride layer co-incident with the holes in the electrode. The underlying $SiO_2$ layer can then be removed by applying an etchant through the holes. The lateral dimension of the air cavity, 18, would then be determined by the extent of etching rather than by photolithography as in the above example.

Further, dimensional control of the membrane radius may be enhanced by including in the surface of the semiconductor a diffused boron ring around the perimeter of the desired membrane. This annular ring is diffused deeper into the semiconductor than the region, 12, to prevent lateral overetching of the semiconductor during membrane formation.

Although the invention has been described with reference to a microphone for use in telecommunications, it should be apparent that the principles described herein are applicable to any electroacoustic transducer which relies on variations in capacitance, whether an acoustic signal is converted to an electrical signal or vice versa. For example, the structure in FIGS. 1 and 3 may function as a speaker by applying a varying electrical signal superimposed on a fixed dc bias to the capacitor electrodes, 17 and 11. This causes vibration of the membrane, 11, due to the variations in electrical field between the electrodes. An acoustic output signal would therefore be produced. Thus, whichever way energy conversion is taking place, the electric field between the electrodes varies in relationship with the vibrating membrane to permit conversion between electrical and acoustic signals.

It will also be realized that the invention is not limited to voice band frequencies (0.5—3.5 kHz) but can be used in the full audio bandwidth (0.02—20 kHz) and may even have applications in the ultrasonic band (20—1000 kHz). Thus, the invention may be used in a variety of applications. For example, a miniature hearing aid could be constructed with a device such as shown in FIG. 3 functioning as a microphone on one end and a similar device functioning as a speaker at the other end (nearest to the eardrum). Between the two devices, the hearing aid could include a battery for powering the devices and a number of IC chips such as digital signal processors and driver/amplifiers. The acoustic output of the hearing aid could therefore be generally linear over the audio range with some shaping of the output by the signal processors to compensate for hearing loss at particular frequencies.

Various modifications of the invention as described above will become apparent to those skilled in the art. All such variations which basically rely on the teachings through which the invention has advanced the art are properly considered within the spirit and scope of the invention.

What is claimed is:

1. An electroacoustic transducer comprising a membrane comprising a thinned portion of a thicker semiconductor substrate, said membrane having a thickness of less than 2.5 $\mu$m and an area such that the membrane is adapted to vibrate at a frequency of at least 0.02 kHz; and a pair of electrodes formed in a spaced relationship so as to constitute a capacitor, where one of said electrodes is formed to vibrate with said membrane such that the electric field between the electrodes varies in relationship with the vibrating membrane to permit conversion between electrical and acoustic signals.

2. The device according to claim 1 wherein the transducer is a microphone and one of the electrodes is formed to vibrate with the membrane such that the capacitance varies in response to an acoustic signal incident on said membrane.

3. The device according to claim 1 wherein the electrode vibrating with the membrane comprises a region of high conductivity in the surface of the semiconductor in the membrane area.

4. The device according to claim 1 wherein the semiconductor comprises silicon.

5. The device according to claim 2 wherein the voltage output of the capacitor monotonically increases with increasing sound pressure level in the interval 50–100 dB.

6. The device according to claim 5 wherein the voltage output of the capacitor is approximately linear.

7. The device according to claim 2 wherein the membrane is adapted to vibrate in response to sound waves having a frequency of 0.5–3.5 kHz.

8. The device according to claim 7 wherein the area of the membrane lies within the range 0.01 to 1.0 $cm^2$.

9. The device according to claim 2 wherein the voltage output of the capacitor is at least 100 $\mu$V.

10. The device according to claim 1 where the other capacitor electrode is stationary and is formed on an insulating layer formed over a spacer layer which is formed on the semiconductor substrate outside the area of the membrane.

11. The device according to claim 1 wherein the other capacitor electrode is formed on a glass cover formed over a spacer layer which is formed on the semiconductor substrate outside the area of the membrane.

12. The device according to claim 10 wherein an air vent is provided to permit escape of air from a cavity formed by the insulating layer and the membrane.

13. Device according to claim 11 wherein an air vent is provided to permit escape of air from a cavity formed by the cover and the membrane.

14. A microphone comprising:

a membrane comprising a thinned portion of a thicker silicon substrate, said membrane having a thickness in the range 0.1–2.5 $\mu$m and an area in the range 0.01 to 1.0 $cm^2$ such that the membrane vibrates in response to sound waves having a frequency of 0.5–3.5 kHz incident on one surface thereof; and a pair of electrodes formed in a spaced relationship so as to constitute a capacitor, where one of said electrodes is formed to vibrate with said membrane such that the capacitance varies in response to the sound waves to produce a voltage output of at least 100 $\mu$V which monotonically increases with increasing sound pressure level in the interval 50–100 dB.

15. A method of forming an electroacoustic transducer which includes a capacitor and a vibrating semiconductor membrane comprising the steps of:

forming a region of high conductivity in a first major surface of the semiconductor;

forming a spacing layer on the first surface in a pattern which exposes the area of the semiconductor which will comprise the membrane and forms a cavity over the said area;

forming an insulating layer over the exposed area to fill the cavity and form an essentially planar surface with the spacing layer;

depositing an electrode over portions of the spacing layer and insulating layer;

depositing a cover layer over the electrode, spacing layer and insulating layer, and forming an opening through said cover layer to the insulating layer;

removing said insulating layer from the cavity to form an air gap between the electrode and the semiconductor surface;

forming a masking layer on the opposite major surface of the semiconductor in a pattern which exposes the area which will comprise the membrane; and etching the semiconductor area exposed by the mask and stopping at the region of high conductivity to form the membrane.

16. The method according to claim 15 wherein the electrode is deposited in a pattern which includes a hub over the insulating layer with spokes extending outward therefrom over the insulating and spacing layers.

17. The method according to claim 15 wherein the spacing layer comprises silicon nitride, the insulating layer comprises phosphorus-doped glass, the electrode comprises polycrystalline silicon, and both the cover layer and masking layer comprise boron nitride.

18. The method according to claim 15 wherein the electroacoustic transducer is a microphone.

* * * * *

UNITED STATES PATENT AND TRADEMARK OFFICE

CERTIFICATE OF CORRECTION

PATENT NO. : 4,558,184

DATED : December 10, 1985

INVENTOR(S) : Ilene J. Busch-Vishniac, W. Stewart Lindenberger, William T. Lynch and Tommy L. Poteat It is certified that error appears in the above-identified patent and that said Letters Patent is hereby corrected as shown below:

In the Title Page, the listing of Inventors as "Ilene J. Busch-Vishniac, Austin, Tex.; W. Stewart Lindenberger, Somerset, N.J." should read --Ilene J. Busch-Vishniac, Austin, Tex.; W. Stewart Lindenberger, Somerset, N.J.; William T. Lynch, Summit, N.J.; Tommy L. Poteat, Bridgewater, N.J.--. Column 1, line 22, "element" should read --elements--. Column 2, line 34, "permissable" should read --permissible--. Column 4, line 55, "contract" should read --contact--. Column 6, line 10, "10 ||m" should read --10 μm--.

Signed and Sealed this

*Twenty-fifth* Day of *February 1986*

[SEAL]

*Attest:*

DONALD J. QUIGG

*Attesting Officer*

*Commissioner of Patents and Trademarks*